United States Patent [19]

Lu-Dai Sung et al.

[11] Patent Number: 4,514,311

[45] Date of Patent: Apr. 30, 1985

[54] WEAR-RESISTANT AIRCRAFT ENGINE LUBRICATING OIL

[75] Inventors: Rodney Lu-Dai Sung, Fishkill; William M. Sweeney, Wappingers Falls; Benjamin H. Zoleski, Beacon, all of N.Y.

[73] Assignee: Texaco Inc., White Plains, N.Y.

[21] Appl. No.: 492,779

[22] Filed: May 9, 1983

[51] Int. Cl.[3] ..... C10M 1/46

[52] U.S. Cl. ..... 252/32.5; 260/924; 260/925

[58] Field of Search ..... 252/32.5, 49.9, 34; 260/924, 925

[56] References Cited

U.S. PATENT DOCUMENTS

| | | | |
|---|---|---|---|
| 2,858,332 | 10/1958 | Watson et al. | 252/32.5 X |
| 3,238,277 | 3/1966 | Sigan et al. | 252/49.9 X |
| 3,720,612 | 3/1973 | Bosniack et al. | 252/32.5 |
| 3,728,260 | 4/1973 | Flowerday et al. | 252/49.9 X |
| 3,785,975 | 1/1974 | Humphrey et al. | 252/32.5 X |
| 3,859,218 | 1/1975 | Jervis et al. | 252/32.5 |
| 4,130,494 | 12/1978 | Shaub et al. | 252/32.5 |
| 4,416,667 | 11/1983 | Kaufman et al. | 260/925 X |

*Primary Examiner*—Andrew Metz

*Attorney, Agent, or Firm*—Robert A. Kulason; Carl G. Seutter

[57] ABSTRACT

A wear-resistant aircraft engine oil contains a reaction product of didodecyl phosphate and

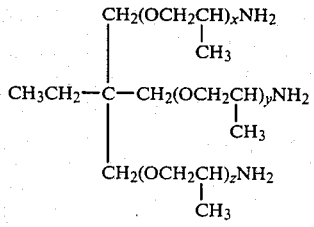

wherein x+y+z is 5.3.

25 Claims, No Drawings

WEAR-RESISTANT AIRCRAFT ENGINE LUBRICATING OIL

FIELD OF THE INVENTION

This invention relates to lubricating oils particularly characterized by improved wear resistance. More particularly it relates to an aircraft engine oil of improved wear performance.

BACKGROUND OF THE INVENTION

As is well known to those skilled in the art, lubricating oils must possess the ability to lubricate surfaces and to minimize the wear which may occur on the surfaces being lubricated. It is an object of this invention to provide a lubricating oil formulation particularly characterized by its improved wear resistance properties. Other objects will be apparent to those skilled in the art.

STATEMENT OF THE INVENTION

In accordance with certain of its aspects, the lubricating oil composition of this invention may comprise (a) a major portion of a lubricating oil suitable for use as an aircraft engine oil; and (b) a minor amount of, as a wear-inhibiting additive, a reaction product of (i) a polyprimary amine $$R(OR'')_a(NH_2)_b$$

wherein

R is a hydrocarbon group;

R'' is a divalent lower alkyl hydrocarbon group;

a is an integer 1–6;

b is an integer 2–5; and (ii) a phosphate ester

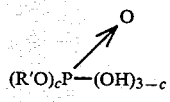

wherein R' contains 1–30 carbon atoms and is alkyl, alkenyl, alkaryl, aralkyl, cycloalkyl, or aryl, and c is an integer 1–2; or (iii) a phosphonic acid

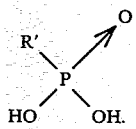

DESCRIPTION OF THE INVENTION

The lubricating oils which may be improved by the process of this invention may include hydrocarbon lubricating oils generally in use for internal combustion engines.

This invention is particularly useful in connection with aircraft engine oils which may be based upon a paraffinic base stock or a synthetic ester fluid or a mixture thereof. These ashless formulations, as is well known, may contain dispersants, anti-foamants, ashless anti-oxidants, etc. A typical standard aircraft engine oil may contain (i) 54.70% Aircraft Oil 120 having a 40° C. viscosity of 305 cSt and a 100° C. viscosity of 23.2 cSt; (ii) 38.00 w% of 145P Pale Turbine Oil having a 40° C. viscosity 27.5 cSt and a 100° C. viscosity of 4.8 cSt; (iii) 6.00 w% of Acryloid 917 brand of polymethacrylate dispersant type viscosity index improver; (iv) 0.30 w% AN-702 brand of hindered phenol antioxidant, and (v) 150 ppm of silicon antifoamant.

When prior art aircraft engine oils have been employed to lubricate piston engines which power small private and commercial aircraft, it is found that the engines are subject to various problems including hydraulic lifter spalling, push rod bending, and oil system contamination from the wear debris.

It is found that improved wear characteristics may be attained by addition to the lubricating oil of 0.5–2.5 w%, preferably 1–2 w%, say 1 w% (of the oil) of the additives of this invention.

The additives of this invention include the reaction products of (i) a polyprimaryamine $$R(OR'')_a(NH_2)_b$$

wherein

R is a hydrocarbon group;

R'' is a divalent lower alkyl hydrocarbon group;

a is an integer 1–6;

b is an integer 2–5; and (ii) a phosphate ester

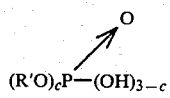

wherein R' contains 1–30 carbon atoms and is alkyl, alkenyl, alkaryl, aralkyl, cycloalkyl, or aryl, and c is an integer 1–2; or (iii) a phosphonic acid

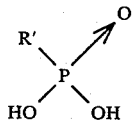

wherein R' is the same as above.

The polyprimaryamines which may be employed are characterized by the formula $$R(OR'')_a(NH_2)_b$$

wherein

R is a hydrocarbon group;

R'' is a divalent lower alkyl hydrocarbon group;

a is an integer 1–6; and b is an integer 2–5.

In the above compound, R may be a hydrocarbon radical selected from the group consisting of alkyl, aralkyl, cycloalkyl, aryl, alkaryl, alkenyl, and alkynyl including such radicals when inertly substituted. When R is alkyl, it may typically be methyl, ethyl, n-propyl, iso-propyl, n-butyl iso-butyl, sec-butyl, amyl, octyl, decyl, octadecyl, etc. When R is aralkyl, it may typically be benzyl, beta-phenylethyl, etc. When R is cycloalkyl, it may typically be cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. When R is alkenyl, it may typically be vinyl, allyl, 1-butenyl, etc. When R is alkynyl, it may typically be ethynyl, propynyl, butynyl, etc. R may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred R groups may be lower alkyl, i.e. $C_3$–$C_{10}$ alkyl, groups including e.g. n-propyl, i-propyl, butyls, amyls, hexyls, octyls, decyls, etc. R may preferably be the group:

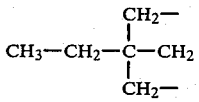

R″ may be a divalent lower ($C_1$ to $C_5$) alkyl hydrocarbon group typically having 2–3 carbon atoms. The preferred R″ groups may include —$CH_2CH_2$— and

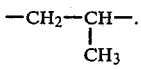

a is an integer 1–6. Preferably a may be 3–6, say 5.3.

a is an integer 1–6. Preferably a may be 3–6, say 5.3.

b may be an integer 2–5. Preferably b may be 2–3 say 3.

A preferred group of polyprimary amines may be the tris[omega-amino(polyalkoxy)methyl] methanes, wherein the alkoxy group is preferably ethoxy or propoxy, typified by 1,1′,1″ tris[omega-amino(polyalkoxy)methyl] propanes such as 1,1′,1″ tris[omega-amino(polypropoxy)methyl] propane.

In the preferred embodiment, the polyprimary amine may contain the nucleus:

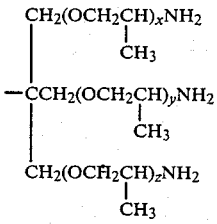

A preferred composition may be:

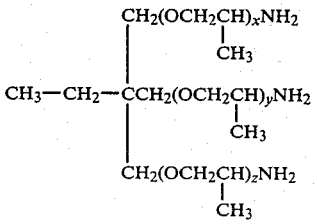

In these compounds, x, y, and z may be integers 1–6, preferably 3–6. Commonly the sum of x, y, and z is 3–6, preferably 5–6, say 5.3.

Illustrative polyprimary amines which may be employed may include:

TABLE

A

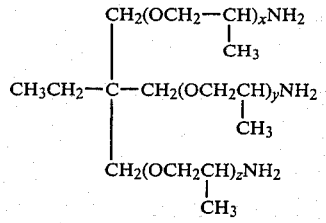

B

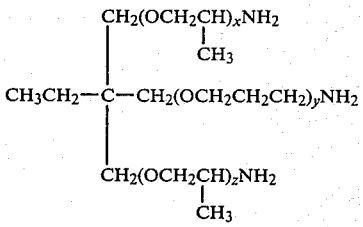

C

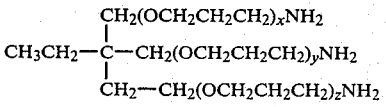

D

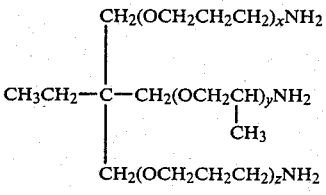

E

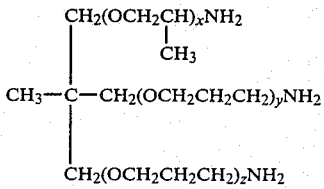

F

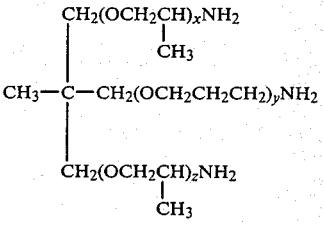

G

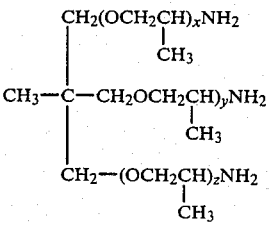

The additives of this invention may be prepared from 1,1′,1″ tris[omega-amino(polyalkoxy)methyl] alkanes typified by 1,1′,1″ tris[omega-amino(polypropoxy)-methyl] methanes and the substituted methane 1,1′,1″ tris[omega-amino(polypropoxy)methyl] propane.

The phosphate ester reactants which may be employed may be characterized by the formula

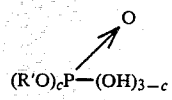

wherein R′ contains 1–30, preferably 5–30, more preferably 10–18, say 12 carbon atoms and is selected from the group consisting of alkyl, alkenyl, alkaryl, aralkyl, cycloalkyl, and aryl hydrocarbon moieties, and c is an integer 1–2.

In the above compound, R′ may be a hydrocarbon radical selected from the group consisting of alkyl, aralkyl, cycloalkyl aryl, alkaryl, alkenyl, and alkynyl including such radicals when inertly substituted. When R′ is alkyl, it may typically be methyl, ethyl, n-propyl, n-butyl, iso-butyl, sec-butyl, amyl, octyl, decyl, octadecyl, etc. When R′ is aralkyl, it may typically be benzyl, betaphenylethyl, etc. When R′ is cycloalkyl, it may typically be cyclohexyl, cycloheptyl, cyclooctyl, 2-methylcycloheptyl, 3-butylcyclohexyl, 3-methylcyclohexyl, etc. When R′ is aryl, it may typically be tolyl, xylyl, etc. When R′ is alkenyl, it may typically be vinyl, allyl, 1-butenyl, etc. When R′ is alkynyl, it may typically be ethynyl, propynyl, butynyl, etc. R′ may be inertly substituted, i.e. it may bear a non-reactive substituent such as alkyl, aryl, cycloalkyl, ether, etc. Typically inertly substituted R′ groups may include 2-ethoxyethyl, carboethoxymethyl, 4-methyl cyclohexyl, etc. The preferred R′ groups may be alkyl groups, containing 10–18 carbon atoms. R′ may preferably be $C_{12}$ dodecyl.

When c is 1, the phosphate ester may be

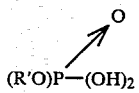

typified by:

TABLE

| | |
|---|---|
| lauryl | phosphate |
| 2-ethylhexyl | phosphate |
| iso-octyl | phosphate |
| stearyl | phosphate |

When c is 2, the phosphate ester may be:

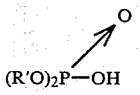

typified by:

TABLE

| | |
|---|---|
| dilauryl | phosphate |
| di-2-ethylhexyl | phosphate |
| di-iso-octyl | phosphate |
| di-stearyl | phosphate |

The phosphonic acid reactants which may be employed may be characterized by the formula

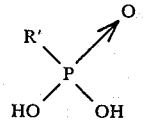

wherein R′ contains 1–30, preferably 5–30, more preferably 10–18, say 14 carbon atoms and is selected from the group consisting of alkyl, alkenyl, alkaryl, aralkyl, cycloalkyl, and aryl hydrocarbon moieties.

In the above compound, R′ may be a hydrocarbon radical selected from the group consisting of alkyl, aralkyl, cycloalkyl aryl, alkaryl, alkenyl, and alkynyl including such radicals when inertly substituted. When R′ is alkyl, it may typically be methyl, ethyl, n-propyl, iso-propyl, n-butyl, iso-butyl, sec-butyl, amyl, octyl, decyl, octadecyl, etc. When R′ is aralkyl, it may typically by benzyl, betaphenylethyl, etc. When R′ is cycloalkyl, it may typically be cyclohexyl, cycloheptyl, cyclooctyl, 2-methylcycloheptyl, 3-butylcyclohexyl, 3-methylcyclohexyl, etc. When R′ is aryl, it may typically be tolyl, xylyl, etc. When R′ is alkenyl, it may typically be vinyl, allyl, 1-butenyl, etc. When R′ is alkynyl, it may typically be ethynyl, propynyl, butynyl, etc. R′ may be inertly substituted i.e. it may bear a non-reactive substituent such as alkyl, aryl, cycloalkyl, ether halogen, nitro, etc. Typically inertly substituted R′ groups may include 3-chloropropyl, 2-ethoxyethyl, carboethoxymethyl, 4-methyl cyclohexyl, p-chlorophenyl, p-chlorobenzyl, 3-chloro-3-methylphenyl, etc. The preferred R′ groups may be an alkyl group, containing 10–18 carbon atoms. R′ may preferably be $C_{14}$, a tetradecyl group when the compound is a phosphonate and $C_{12}$ lauryl when the compound is a phosphate.

These phosphonic acids may be readily available or they may be prepared typically by the reaction of olefins with phosphites. In a typical reaction, one gram mole of tetradecene may be reacted with 1.5 gram moles of dimethyl phosphite and a catalytic amount (4 g) of ditertiary-butyl peroxide. The mixture is heated at 150° C. for 4 hours. After cooling, aqueous hydrochloric acid is added and the mixture extracted with toluene solvent. The solvent mixture is separated and toluene is stripped off to leave the 1:1 adduct—typically tetradecyl phosphonic acid.

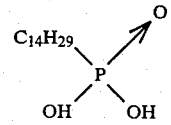

Illustrative phosphonic acids which may be employed may include:

TABLE

| | |
|---|---|
| tetradecyl | phosphonic acid |
| decyl | phosphonic acid |
| dodecyl | phosphonic acid |
| nonyl | phosphonic acid |

In practice of the process of this invention, one equivalent of the polyprimary amine may typically be reacted with one equivalent of phosphate or phosphonic acid ester. Although it may be preferred to react about equimolar quantities of the two reactants in one embodiment, it is possible in other embodiments to react one mole of the phosphate or phosphonic acid per amine group.

In the preferred embodiment, the reactants may include one mole of the triamine and one mole of the phosphate ester. In other embodiments, one mole of the triamine may be reacted with two moles of the phosphate ester. Generally quaternization may be effected by use of a wide range of ratios of amine groups to free hydrogen (on the phosphate ester)—typically 1-3:1, preferably 1-2:1, say 1:1.

In a typical reaction, the following may occur:

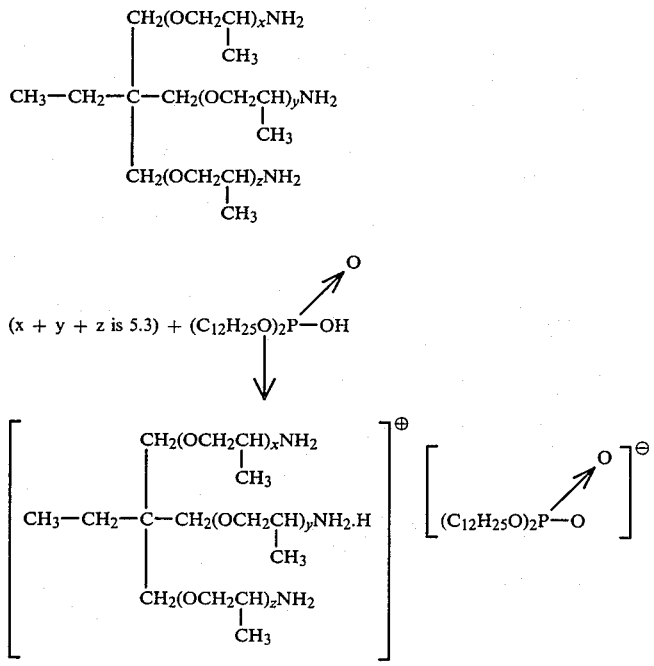

In another illustrative embodiment, wherein reactants include one mole of the triamine and two moles of the phosphate ester, the wear-inhibiting additive product may be:

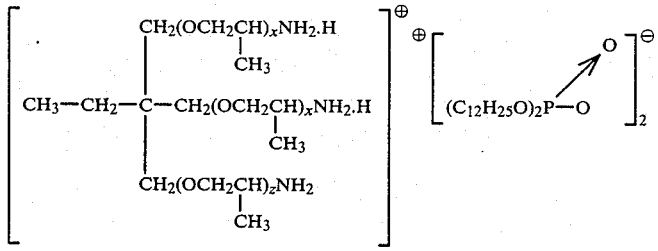

It is preferred to add the wear-inhibiting additive to the lubricating oil composition in amount of 0.5-2.5 w%, preferably 1-2 w%, say 1 w% of the lubricating oil. The additive may be mixed with the oil to obtain a uniform composition.

A typical aircraft engine oil which may be improved by the process of this invention may contain the following:

(i) 38.00 parts of 145P Pale Turbine Oil—A mineral oil having a 40° C. viscosity of 27.5 cSt and a 100° C. viscosity of 4.8 cSt;

(ii) 54.70 parts of Aircraft Oil 120 a mineral oil having a 40° C. viscosity of 305 cSt and a 100° C. viscosity of 23.2 cSt;

(iii) 0.30 parts of the AN-702 hindered phenol antioxidant;

(iv) 6.00 parts of the Acryloid 917 brand of polymethacrylate dispersant viscosity index improver; and (v) 1.50 parts per million of silicone antifoamant.

The wear-inhibiting improvements may be observed by testing the lubricating oil compositions containing the additives in the Four Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting in the three lower balls to form a tetrahedron is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

When measured on this basis, it is possible to achieve improvements by a factor of as much as 3–4, i.e. the measured scar diameter is decreased to as little as 25%–30% of that observed in control runs.

The load, temperature, time, and speed of rotation may be changed to simulate desired conditions.

DESCRIPTION OF PREFERRED EMBODIMENT

Practice of this invention will be apparent to those skilled in the art from the following wherein, as elsewhere in this specification, all parts are parts by weight unless otherwise specified.

EXAMPLE I

In this example which represents the best mode known to me of practicing the process of this invention, there is charged to a 250 ml round bottom flask equipped with an overhead stirrer 44.5 parts (0.1 equivalent) of tris-aminopolypropoxylated-trimethylol propane

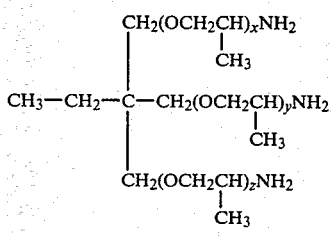

wherein x+y+z is 5.3 and 43 parts (0.1 equivalent) of didodecyl phosphate

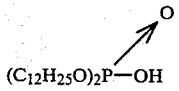

The reaction mixture is agitated for 30 minutes at room temperature of 25° C.

This additive (1 part) is added to 99 parts of the standard aircraft engine oil supra.

The composition is subjected to the Four Ball Wear Test for one hour at 200° F. at 1800 RPM with a load of 40 Kg. The scar diameter is measured.

EXAMPLE II*

In this control example, the oil of Example I with no additive is subjected to the test.

TABLE

| EXAMPLE | AVERAGE SCAR DIAMETER (mm) |
|---|---|
| I | 0.43 |
| II* | 1.6 |

From the above table, it is apparent that the additive of this invention permits attainment of improvement of 371% (i.e. 1.6/0.43) over the base oil.

Comparable results may be attained if the amine is (from the Table supra):

| Example | Amine |
|---|---|
| III | A |
| IV | B |
| V | C |
| VI | D |
| VII | E |

-continued

| Example | Amine |
|---|---|
| VIII | F |

Comparable results may be attained if the phosphate or phosphonic acid is:

| Example | Ester |
|---|---|
| IX | 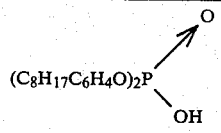 |
| X | 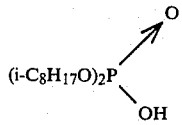 |
| XI | 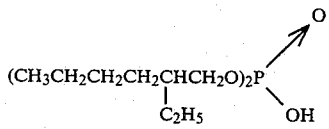 |

Although this invention has been illustrated by reference to specific embodiments, it will be apparent to those skilled in the art that various changes and modifications may be made which clearly fall within the scope of this invention.

We claim:

1. An aircraft engine lubricating oil composition which comprises (a) a major portion of a lubricating oil; and (b) a minor wear-inhibiting amount of, a reaction product of (i) a polyprimaryamine $$R(OR'')_a(NH_2)_b$$

wherein

R is a hydrocarbon group;

R'' is a divalent lower alkyl hydrocarbon group;

a is an integer 1–6;

b is an integer 2–5; and (ii) a phosphate ester

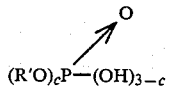

wherein R' contains 1–30 carbon atoms and is alkyl, alkenyl, alkaryl, aralkyl, cycloalkyl, or aryl, and c is an integer 1–2; or a phosphonic acid

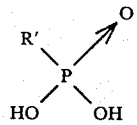

wherein the reaction product is prepared at ambient conditions and wherein the ratio of amine groups to free hydrogen on the phosphate ester or phosphonic acid is 1–3:1.

2. A lubricating oil composition as claimed in claim 1 wherein said polyprimaryamine is

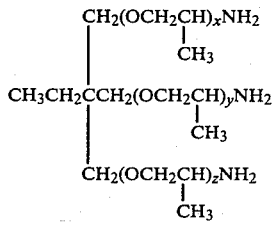

and the sum of x, y, and z is 3–6.

3. A lubricating oil composition as claimed in claim 1 wherein said R′ contains 10–14 carbon atoms.

4. A lubricating oil composition is claimed in claim 1 wherein phosphate ester is

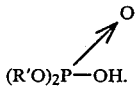

5. A lubricating oil composition as claimed in claim 1 wherein said phosphate ester is

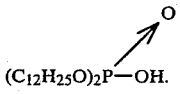

6. A lubricating oil composition as claimed in claim 1 wherein said phosphate ester is

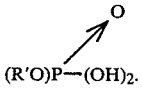

7. A lubricating oil composition as claimed in claim 1 wherein said wear-inhibiting amount is 1–2 w% of said lubricating oil.

8. An aircraft engine lubricating oil composition which comprises (a) a major portion of a lubricating oil and (b) a minor wear-inhibiting amount of, a reaction product of (i) as an amine reactant, a tris[omega-amino(polyalkoxy)methyl]methane and (ii) a phosphate ester $(R'O)_cP—(OH)_{3-c}$ wherein R′ contains 1–30 carbon atoms and is alkyl, alkenyl, alkaryl, aralkyl, cycloalkyl, or aryl, and c is an integer 1–2; or a phosphonic acid

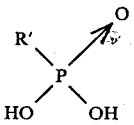

wherein the reaction product is prepared at ambient conditions and wherein the ratio of amine groups to free hydrogen on the phosphate ester or phosphonic acid is 1–3:1.

9. A lubricating oil composition as claimed in claim 8 wherein said amine reactant is an 1,1′1″tris[omega-amino(polyalkoxy)methyl]propane.

10. A lubricating oil composition as claimed in claim 8 wherein said amine reactant is a 1,1′1″tris[omega-amino(polypropoxy)methyl]propane.

11. An aircraft engine lubricating oil composition which comprises (a) a major portion of a lubricating oil; and (b) a minor wear-inhibiting amount of, a reaction product of (i) a polyprimaryamine

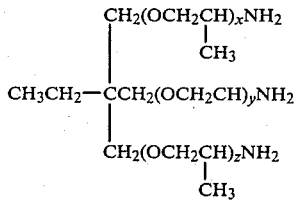

wherein x is 1–3;

y is 1–3;

z is 1–3; and the sum of x, y, and z is 3–6; and (ii) a phosphate ester

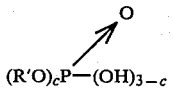

wherein R′ contains 1–30 carbon atoms and is alkyl, alkenyl, alkaryl, aralkyl, cycloalkyl, or aryl, and c is an integer 1–2; or a phosphonic acid

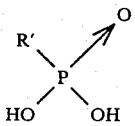

wherein the reaction product is prepared at ambient conditions and wherein the ratio of amine groups to free hydrogen on the phosphate ester or phosphonic acid is 1–3:1.

12. A lubricating oil composition as claimed in claim 11 wherein said phosphate ester is didodecyl phosphate.

13. The method of improving the wear-resistance properties of an aircraft engine lubricating oil composition which comprises adding to a lubricating oil a minor wear-inhibiting amount of, a reaction product of (i) a polyprimaryamine $R(OR'')_a(NH_2)_b$ wherein R is a hydrocarbon group;

R″ is a divalent lower alkyl hydrocarbon group;

a is an integer 1–6;

b is an integer 2–5; and (ii) a phosphate ester $(R'O)_cP—(OH)_{3-c}$;

wherein R′ contains 1–30 carbon atoms and is alkyl, alkenyl, alkaryl, aralkyl, cycloalkyl, or aryl, and c is an integer 1–2; or a phosphonic acid

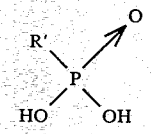

wherein the reaction product is prepared at ambient conditions and wherein the ratio of amine groups to free hydrogen on the phosphate ester or phosphonic acid is 1–3:1.

14. The method of improving the wear-resistance properties of a lubricating oil as claimed in claim 13 wherein said polyprimaryamine is

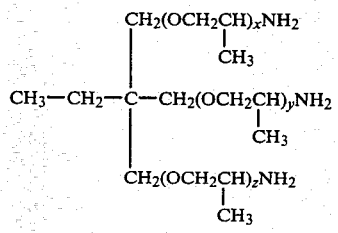

and the sum of x, y, and z is 3–6.

15. The method of improving the wear-resistance properties of a lubricating oil as claimed in claim 13 wherein said R′ contains 10–14 carbon atoms.

16. The method of improving the mean resistance of a lubricating oil is claimed in claim 13 wherein said phosphate ester is

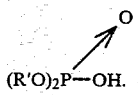

17. The method of improving the wear-resistance properties of an aircraft engine lubricating oil composition which comprises adding to a lubricating oil a minor wear-inhibiting amount of, a reaction product of (i) a polyprimaryamine

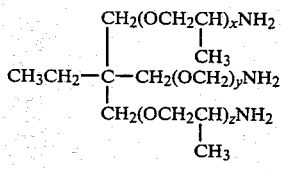

wherein x is 1–3;

y is 1–3;

z is 1–3;

and the sum of x, y, and z is 3–6; and (ii) a phosphate ester

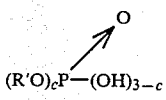

wherein R′ contains 1–30 carbon atoms and is alkyl, alkenyl, alkaryl, aralkyl, cycloalkyl, or aryl, and c is an integer 1–2; or a phosphonic acid

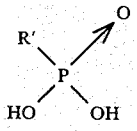

wherein the reaction product is prepared at ambient conditions and wherein the ratio of amine groups to free hydrogen on the phosphate ester or phosphonic acid is 1–3:1.

18. A novel composition comprising the reaction product of (i) a polyprimaryamine

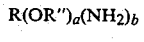

wherein

R is a hydrocarbon group;

R″ is a divalent lower alkyl hydrocarbon group;

a is an integer 1–6;

b is an integer 2–5; and (ii) a phosphate ester

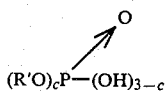

wherein R′ contains 1–30 carbon atoms and is alkyl, alkenyl, alkaryl, aralkyl, cycloalkyl, or aryl, and c is an integer 1–2; or a phosphonic acid

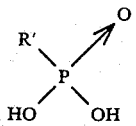

wherein the reaction product is prepared at ambient conditions and wherein the ratio of amine groups to free hydrogen on the phosphate ester or phosphonic acid is 1–3:1.

19. A novel composition as claimed in claim 18 wherein said polyprimaryamine is

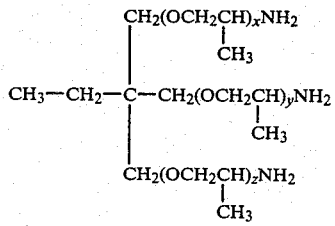

and the sum of x, y, and z is 3–6.

20. A novel composition as claimed in claim 18 wherein said R′ contains 10–14 carbon atoms.

21. A novel composition as claimed in claim 18 wherein said phosphate ester is

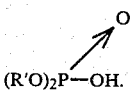

22. A novel composition as claimed in claim 18 wherein said phosphate ester is

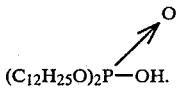

23. A novel composition as claimed in claim 18 wherein said phosphate ester is

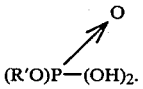

24. A novel composition comprising the reaction product of, as an amine reactant, a tris[omega-amino(-polyalkoxy)methyl]methane and a phosphate ester $(R'O)_cP—(OH)_{3-c}$ wherein R′ contains 1–30 carbon atoms and is alkyl, alkenyl, alkaryl, aralkyl, cycloalkyl, or aryl, and c is an integer 1–2 or a phosphonic acid

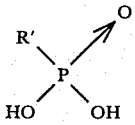

wherein the reaction product is prepared at ambient conditions and wherein the ratio of amine groups to free hydrogen on the phosphate ester or phosphonic acid is 1–3:1.

25. A novel composition comprising the reaction product of, as an amine reactant, a bis[omega-amino(-polyalkoxy)methyl]propane and a phosphonic acid

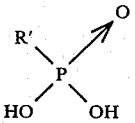

wherein R′ contains 1–30 carbon atoms and is alkyl, alkaryl, aralkyl, cycloalkanyl, alkenyl or aryl hydrocarbon group, wherein the reaction product is prepared at ambient conditions and wherein the ratio of amine groups to free hydrogen on the phosphonic acid is 1–3:1.

* * * * *